US010066880B2

(12) United States Patent
Ueno et al.

(10) Patent No.: US 10,066,880 B2
(45) Date of Patent: Sep. 4, 2018

(54) AIR-COOLED HEAT EXCHANGER SYSTEM

(71) Applicant: CHIYODA CORPORATION, Yokohama-shi (JP)

(72) Inventors: Masao Ueno, Yokohama (JP); Yoshiaki Sakomoto, Yokohama (JP); Fumiaki Sakai, Yokohama (JP); Kensaku Suzuki, Yokohama (JP); Atsumasa Ishikawa, Yokohama (JP)

(73) Assignee: CHIYODA CORPORATION, Kanagawa (JP)

( * ) Notice: Subject to any disclaimer, the term of this patent is extended or adjusted under 35 U.S.C. 154(b) by 280 days.

(21) Appl. No.: 14/426,350

(22) PCT Filed: Aug. 14, 2013

(86) PCT No.: PCT/JP2013/004861

§ 371 (c)(1),
(2) Date: Mar. 5, 2015

(87) PCT Pub. No.: WO2014/038142

PCT Pub. Date: Mar. 13, 2014

(65) Prior Publication Data

US 2015/0233651 A1 Aug. 20, 2015

(30) Foreign Application Priority Data

Sep. 6, 2012 (JP) ..... 2012-195924

(51) Int. Cl.
*F28F 9/02* (2006.01)
*F28D 1/04* (2006.01)
*F28D 1/02* (2006.01)

(52) U.S. Cl.
CPC ..... *F28F 9/02* (2013.01); *F28D 1/04* (2013.01); *F28D 2001/028* (2013.01);
(Continued)

(58) Field of Classification Search
CPC .. F28F 2265/14; F28F 2265/26; F28F 9/0231; F28F 2255/02; F28F 9/0246; F28D 15/0241
See application file for complete search history.

(56) References Cited

U.S. PATENT DOCUMENTS 1,884,080 A * 10/1932 Miller ..... F28F 9/0219 165/176
2,053,780 A * 9/1936 Price ..... F28D 7/06 126/109

(Continued)

FOREIGN PATENT DOCUMENTS

JP 51-60047 A 5/1976
JP 63-30769 U 2/1988

(Continued)

OTHER PUBLICATIONS

International Search Report for PCT/JP2013/004861 dated Nov. 19, 2013 and its translation thereof.

(Continued)

*Primary Examiner* — Frantz Jules
*Assistant Examiner* — Lionel Nouketcha
(74) *Attorney, Agent, or Firm* — Ladas & Parry, LLP

(57) ABSTRACT

In an air-cooled heat exchanger system, the stress in the pipe connecting the upstream main pipe of the upstream manifold and each heat exchanger is minimized by using a simple structure. The air-cooled heat exchanger system (1) comprises an upstream manifold (6) including a plurality of upstream branch pipes (18) extending therefrom, a heat exchanger (4) connected to the downstream end of each branch pipe, and including an inlet header (31) placed on a base frame in a moveable manner, an outlet header and a plurality of heat transfer tubes (34) connecting the two headers, and a connecting member (41, 75) connecting each adjacent pair of the inlet headers. The upstream manifold, (Continued)

the inlet headers and the connecting members have a similar thermal coefficient so that when the upstream manifold expands thermally, the corresponding thermal expansion of the inlet headers and the connecting members causes the inlet headers to move relative to the base frame by an amount corresponding to the thermal expansion of the upstream manifold.

10 Claims, 8 Drawing Sheets

(52) U.S. Cl.
CPC ..... *F28F 9/0246* (2013.01); *F28F 2265/14* (2013.01); *F28F 2265/26* (2013.01)

(56) References Cited

U.S. PATENT DOCUMENTS 2,237,903 A * 4/1941 Drake ..... F28B 1/00 165/144
2,401,918 A * 6/1946 Elder ..... F28B 1/06 165/122
2,938,712 A * 5/1960 Bengt ..... F28D 7/06 122/235.11
3,376,917 A * 4/1968 Smith ..... F25B 39/04 165/111
3,447,598 A * 6/1969 Kaess, Jr. ..... F28B 1/06 165/122
3,610,324 A * 10/1971 Davidson ..... F28B 1/06 165/69
3,838,048 A * 9/1974 Hedge ..... C08L 27/14 252/388
4,202,405 A * 5/1980 Berg ..... F28B 1/06 165/110
7,726,388 B2 * 6/2010 Toda ..... F28D 1/05366 165/143
7,735,525 B2 * 6/2010 Lunsford ..... G01N 30/30 138/109
2004/0007349 A1 * 1/2004 Youn ..... F25B 39/04 165/115
2010/0078147 A1 * 4/2010 Samyn ..... F28B 1/06 165/47
2010/0206163 A1 * 8/2010 Mizutani ..... C23C 18/165 92/169.1

FOREIGN PATENT DOCUMENTS

JP 63-083583 4/1988
JP 63-134265 U 9/1988
JP 09-079768 A 3/1997
JP 09-287885 11/1997
JP 2012-37069 A 2/2012

OTHER PUBLICATIONS

Written Opinion of the International Searching Authority for PCT/JP2013/004861 dated Nov. 19, 2013 and its translation thereof.
International Preliminary Report on Patentability for PCT/JP2013/004861 dated Mar. 10, 2015 and its translation thereof.

* cited by examiner

AIR-COOLED HEAT EXCHANGER SYSTEM

CROSS-REFERENCE TO RELATED APPLICATION

This application is the U.S. National Stage of International Patent Application No. PCT/JP2013/004861, filed on Aug. 14, 2013, which claims priority to Japanese Patent Application No. 2012-195924 filed on Sep. 6, 2012, entitled "AIR-COOLED HEAT EXCHANGER SYSTEM", the disclosures of which are hereby incorporated by reference in their entireties.

TECHNICAL FIELD

The present invention relates to an air-cooled heat exchanger system, and in particular to an air-cooled heat exchanger system for use in chemical plants, LNG plants and power stations.

In large facilities such as power stations, air-cooled heat exchanger systems are used for cooling fluid media which are raised in temperature owing to heat exchange, compression, distillation, reaction and so on. See Patent Document 1, for instance. The air-cooled heat exchanger system disclosed in Patent Document 1 comprises a base frame made of a rectangular steel frame, a plurality of heat exchangers occupying an upper opening of the base frame and each including fin-tube type heat transfer tubes, a fan unit configured to blow cooling air onto the outer surfaces of the heat transfer tubes, an upstream manifold (header) for supplying high temperature fluid to the heat exchangers and a downstream manifold for returning the fluid that has passed through the heat exchangers back to the high temperature facility. The upstream manifold includes a main pipe at the upstream end thereof and a plurality of branch pipes branching out from the main pipe and connected to the corresponding heat exchangers at the downstream ends thereof.

PRIOR ART DOCUMENT(S)

Patent Document(s)
Patent Document 1: JP09-079768A

SUMMARY OF THE INVENTION

Task to be Accomplished by the Invention

In the upstream manifold of this air-cooled heat exchanger system, the main pipe thermally expands owing to the high temperature fluid that flows therein, and the positions of the upstream ends of the branch pipes move along the length of the main pipe with respect to the base frame. The heat exchangers also individually expand thermally owing to the high temperature fluid flowing therein, but as the heat exchangers are spaced from each other, the movement of the heat exchangers relative to the base frame is significantly smaller than the movement of the upstream main pipe relative to the base frame. Therefore, a relative displacement occurs between the upstream end and the downstream end of each branch pipe, and the resulting stress in the connecting portions between the branch pipes and the main pipe and between the branch pipes and the heat exchangers could damage the branch pipes.

To avoid this problem, as shown in FIG. 8, a plurality of perpendicularly bent portions (elbows) 204 may be formed in intermediate points of a branch pipe 203 connecting a main pipe 201 with a heat exchanger 202 so that the branch pipe 203 is allowed to deflect (deflection or opening angle) at the time of a thermal expansion, and the stress of the branch pipe 203 is minimized. However, the inclusion of such elbows in the branch pipe increases the overall length of the branch pipe, and leads to the rise in the manufacturing cost due to the increased material cost and labor cost. The repetition of deformation at each elbow could eventually cause damage to the elbow.

The present invention was made in view of such problems of the prior art, and has a primary object to minimize stress in the pipe connecting an upstream manifold with heat exchangers in an air-cooled heat exchanger system at the time of thermal expansion by using a highly simple structure.

Means to Accomplish the Task

To achieve such an object, the present invention provides an air-cooled heat exchanger system, comprising: a base frame (3); an upstream manifold (6) including an upstream main pipe (16) extending in a first direction, an upstream inlet pipe (17) communicating with the upstream main pipe to feed fluid to the upstream main pipe and a plurality of branch pipes (18) extending from the upstream main pipe at different points along the first direction; a heat exchanger (4) including an inlet header (31) communicating with each of the branch pipes, a tube bundle (35, 36) communicating with the inlet header at one end thereof and an outlet header (33) communicating with the other end of the tube bundle, the inlet header being moveably mounted on the base frame; and a connecting member (41; 75) connecting the inlet headers of at least two of the heat exchangers to each other, the connecting member having a substantially same thermal expansion coefficient as the upstream main pipe.

According to this arrangement, the upstream manifold is heated by the fluid flowing therein, and the connecting members and the inlet headers are also heated in a similar manner as they are thermally in a similar condition as the upstream manifold (in particular the upstream main pipe) so that they expand thermally in a similar manner. As a result, the relative displacement between the upstream end and the downstream end of each branch pipe is minimized. Therefore, even without using deformable structures such as elbows in each branch pipe, damage to the branch pipe can be minimized, and the structure of each branch pipe can be simplified. This also contributes to the reduction in the manufacturing cost.

The inlet header may be slidably or otherwise moveably mounted on the base frame by using a low friction member (71) or a deformable member (71) interposed between the inlet header and the base frame.

To bring each connecting member in a thermally similar condition as the upstream manifold, the connecting member may be at least partly covered by thermal insulation material (42).

Typically, the inlet header and the outlet header of each heat exchanger are placed one above the other, and the tube bundle includes a first tube bundle (35) extending from the inlet header in a second direction substantially perpendicular to the first direction and a second tube bundle (36) extending from a remote end of the first tube bundle to the outlet header in parallel with the first tube bundle, and wherein the system further includes a downstream manifold (7) including a downstream main pipe (51) extending in the first direction, a downstream outlet pipe (52) communicating with the downstream main pipe to expel fluid from the downstream main pipe and a plurality of branch pipes (53) extending from the downstream main pipe at different points along the first direction, and each communicating with the outlet header of a corresponding one of the heat exchangers. Preferably, each heat exchanger further includes an intermediate header (32) which is connected between the remote end of the first tube bundle and a corresponding end of the second tube bundle.

In this case, the inlet header and the outlet header of each heat exchanger may be fixedly attached to each other so as to jointly form a header unit, and the header unit may be slidably or otherwise moveably supported by the base frame. Thereby, the overall structure can be simplified.

Alternatively, the inlet header and the outlet header of each heat exchanger may be both supported by the base frame in an individually movable manner so that both the inlet header and the outlet header of each heat exchanger may be allowed to be displaced in a corresponding manner to the thermal expansions of the upstream manifold and the downstream manifold, respectively.

Thereby, a particularly accurate matching between the displacement of the inlet header and the thermal expansion of the upstream manifold and between the displacement of the outlet header and the thermal expansion of the downstream manifold can be accomplished.

Preferably, the upstream inlet pipe is connected to an intermediate point of the upstream main pipe which is fixedly attached to a fixed support member. Thereby, the upstream main pipe is allowed to expand thermally in outward directions from the fixed intermediate point so that the maximum displacement in the upstream main pipe can be minimized.

In such a case, an optimum result can be achieved if the inlet header of the heat exchanger adjacent to the support member is connected to the support member via the connecting member.

Thereby, the array of the inlet headers and the connecting members can be expanded thermally in a substantially similar manner as the upstream main pipe of the upstream manifold.

Effect of the Invention

According to the structures discussed above, the stress in each branch pipe due to thermal expansion can be minimized by using a highly simple structure.

Various embodiments of the air-cooled heat exchanger system 1 according to the present invention are now described in the following with reference to the appended drawings. In each of the embodiments, the air-cooled heat exchanger system 1 is used for cooling refrigerant or the like in various plants, such as refrigerant for use in a LNG liquefaction plant. The refrigerant may consist of per se known refrigerant such as water, ammonia, ethylene and propylene.

DETAILED DESCRIPTION OF THE INVENTION

First Embodiment

Figure 1:
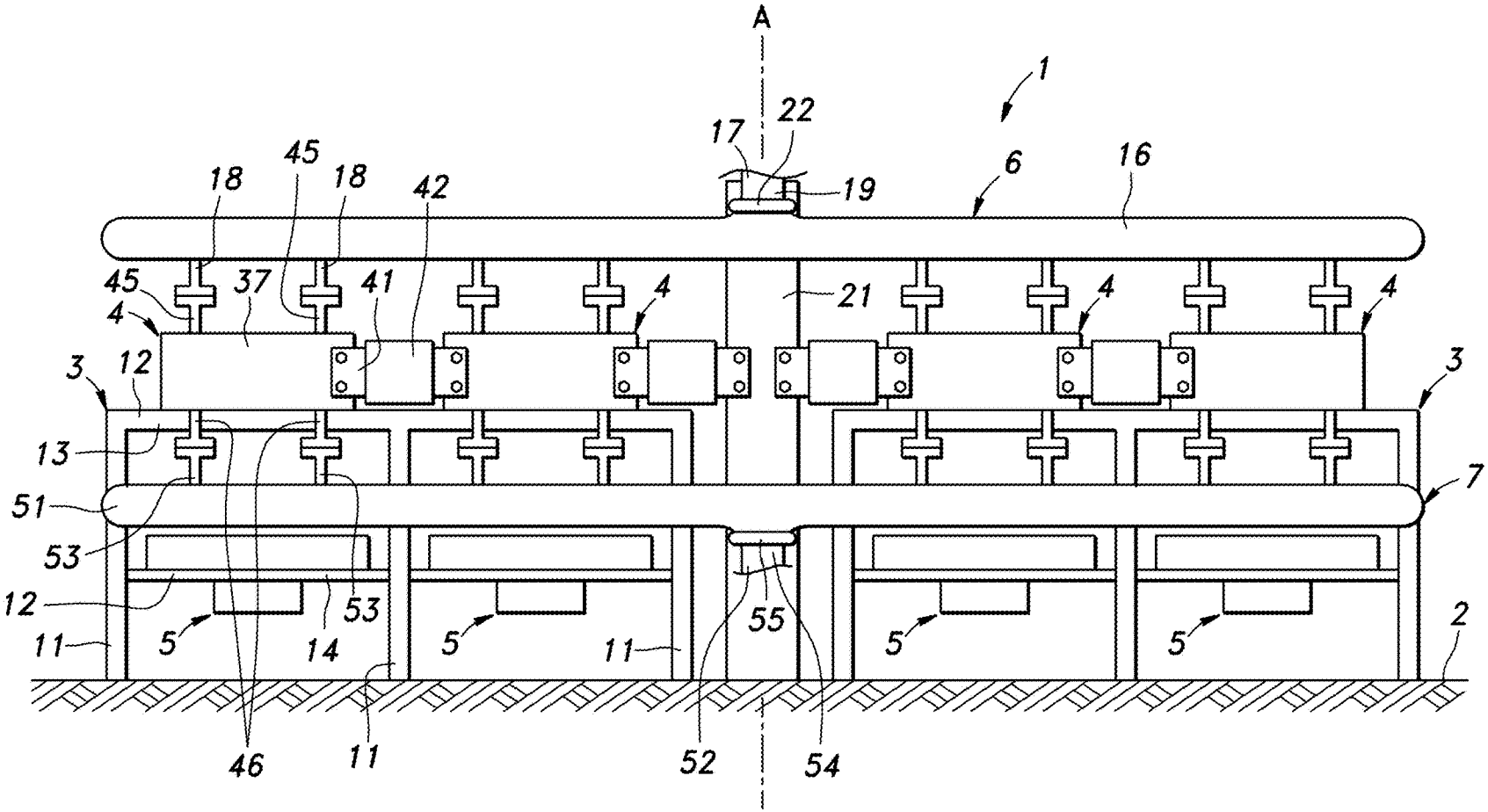
FIG. 1 is a side view showing an air-cooled heat exchanger system given as a first embodiment of the present invention.
Figure 2:
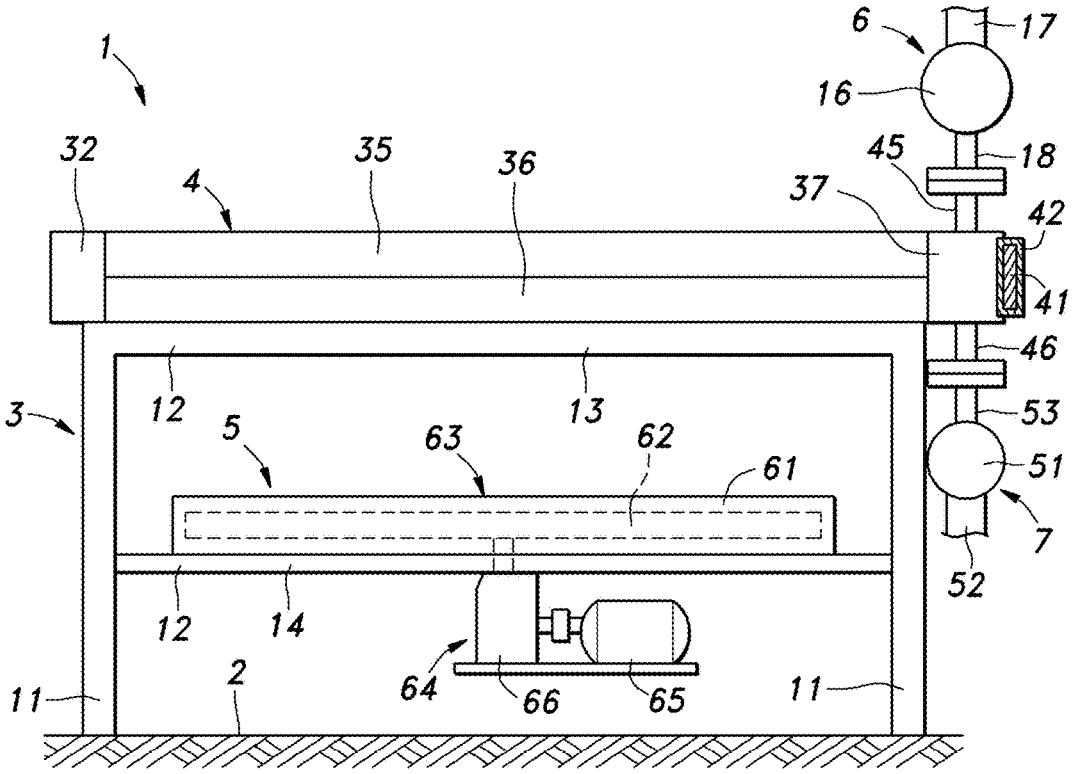
FIG. 2 is a side view showing a single unit (a single bay) of the air-cooled heat exchanger system of the first embodiment.

Referring to FIGS. 1 and 2, the air-cooled heat exchanger system 1 of the first embodiment comprises a base frame 3 standing upright from a base surface 2 (such as a ground surface and a floor surface), a plurality of heat exchangers 4 and corresponding fan units 5 placed on the base frame 3, an upstream manifold 6 for supplying refrigerant to the heat exchangers 4 and a downstream manifold 7 for expelling the refrigerant that has passed through the heat exchangers 4.

The base frame 3 consists of a metallic frame that includes a plurality of pillars 11 and a plurality of beams 12 that extend horizontally between the pillars 11. The beams 12 define a rectangular frame in plan view on the top ends of the pillars 11, thereby defining a heat exchanger support portion 13. The beams 12 further define another rectangular frame in plan view under the heat exchanger support portion 13, thereby defining a fan unit support portion 14. The heat exchanger support portion 13 and the fan unit support portion 14 each define a flat horizontal surface.

The upstream manifold 6 extends linearly and horizontally, and includes an upstream main pipe 16, an upstream inlet pipe 17 connected to a lengthwise middle point of the upstream main pipe 16 and a plurality of linear upstream branch pipes 18 connected to the upstream main pipe 16. The upstream branch pipes 18 are arranged at an interval in the lengthwise direction of the upstream main pipe 16. The refrigerant is supplied from the upstream inlet pipe 17 to the upstream main pipe 16, and hence to the upstream branch pipes 18. The upstream main pipe 16 is sufficiently greater in diameter than the upstream branch pipes 18 so that the refrigerant can be supplied to each upstream branch pipe 18 at a uniform pressure. The upstream manifold 6 is fixedly secured to a columnar support member 21 standing upright in a fixed relationship to the base surface 2 at a connecting portion 19 defined between the upstream inlet pipe 17 and the upstream main pipe 16 by using a connecting member 22 such as a U bolt and a clamp. Alternatively, the support member 21 may be integrally formed with the base frame 3. When a plumb line passing through the connecting portion 19 defined between the upstream inlet pipe 17 and the upstream main pipe 16 is designated as a reference line (center line) A of the air-cooled heat exchanger system 1, the thermal expansion of the upstream manifold 6 occurs in such a manner that the upstream main pipe 16 elongates outwardly in the lengthwise direction thereof from the reference line A while the connecting portion 19 remains substantially fixed in position. The upstream manifold 6 may be supported by the support member 21 via deformable members (such as springs) at various points of the upstream main pipe 16 so as not to obstruct the thermal expansion of the upstream manifold 6.

Figure 3:
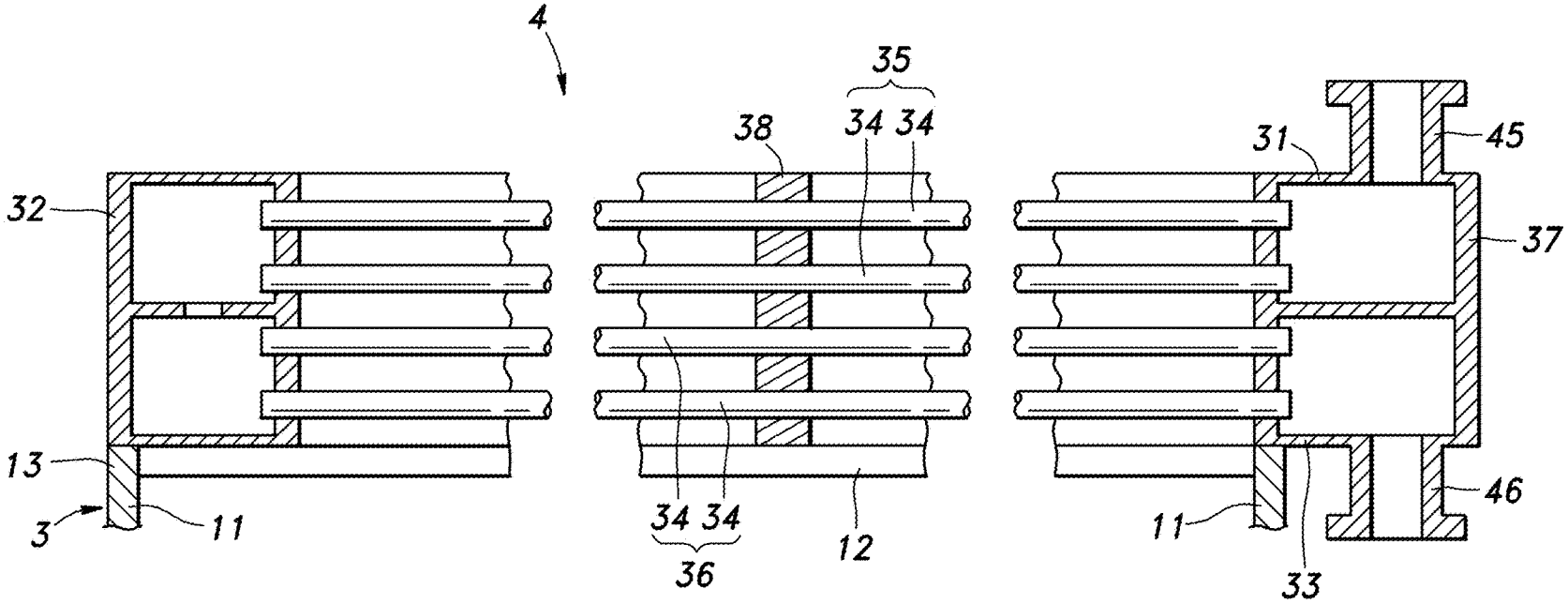
FIG. 3 is a sectional view of one of the heat exchangers.

As shown in FIG. 3, each heat exchanger 4 includes an inlet header 31, an intermediate header 32, an outlet header 33, a first tube bundle 35 consisting of a plurality of heat transfer tubes 34 communicating the interiors of the inlet header 31 and the intermediate header 32 with each other, and a second tube bundle 36 consisting of a plurality of heat transfer tubes 34 communicating the interiors of the intermediate header 32 and the outlet header 33 with each other. The inlet header 31, the intermediate header 32 and the outlet header 33 each consist of a hollow box internally defining a space. The inlet header 31 and the outlet header 33 are mechanically connected to each other on the outside without the interiors thereof communicating with each other, and jointly form an integral header unit 37. The first tube bundle 35 extends from the inlet header 31 perpendicularly to the lengthwise direction of the upstream main pipe 16, and the intermediate header 32 is connected to the remote end of the first tube bundle 35 so that the intermediate header 32 is spaced apart from the inlet header 31. The second tube bundle 36 extends from the intermediate header 32 to the outlet header 33 in parallel with the first tube bundle 35. The heat transfer tubes 34 forming the first and second tube bundles 35 and 36 each extend linearly and may be fitted with fins to increase the surface area thereof. In the first and second tube bundles 35 and 36, the heat transfer tubes 34 are arranged in a plurality of layers. The lengthwise middle points of the heat transfer tubes 34 forming the first and second tube bundles 35 and 36 are passed through a tube spacer 38 defining a plurality of through holes. By thus passing the heat transfer tubes 34 of the first and second tube bundles 35 and 36 through the tube spacer 38, the heat transfer tubes 34 can be kept in a mutually spaced apart relationship.

Each heat exchanger 4 slidably rests upon the heat exchanger support portion 13 on the base frame 3 at the inlet header 31 and the intermediate header 32 of the header unit 37. With each heat exchanger 4 resting on the heat exchanger support portion 13, the inlet header 31 is placed above the outlet header 33, and the first and second tube bundles 35 and 36 extend horizontally. In this conjunction, when seen in plan view, the heat exchangers 4 are placed on the base frame 3 such that the heat transfer tubes 34 of the first and second tube bundles 35 and 36 extend perpendicularly to the direction along which the upstream main pipe 16 of the upstream manifold 6 extends. The heat exchangers 5 are arranged along the length of the upstream main pipe 16. The header unit 37 of each heat exchanger 4 is connected to the header unit 37 of the adjoining heat exchanger 4 via a connecting plate 41. Each connecting plate 41 is connected to the corresponding header units 37 in a heat exchanging relationship, optionally, with grease applied to the contact surfaces thereof. Each header unit 37 adjoining the reference line A is connected to the support member 21 also via a connecting plate 41. Each connecting plate 41 is planar in shape, and has a major plane extending perpendicularly to the heat transfer tubes 34 of the first and second tube bundles 35 and 36. Each connecting plate 41 is attached to the header unit 37 or the support member 21, as the case may be, at each axial end (along the length of the upstream main pipe 16) thereof by using threaded bolts. Alternatively, each connecting plate 41 may also be attached to the header unit 37 or the support member 21 by welding. Each connecting plate 41 may be mostly covered by thermal insulation material 42 except for the parts thereof connected to the header unit 37 (or the support member 21). By using the thermal insulation material 42, the temperature of each connecting plate 41 can be kept close to that of the header unit 37.

Each inlet header 31 is provided with a pair of inlet pipes 45 projecting linearly upward therefrom. The terminal end of each inlet pipe 45 is connected to the opposing end of the corresponding upstream branch pipe 18. Each outlet header 33 is provided with a pair of outlet pipes 46 projecting downward. In the illustrated embodiment, the inlet header 31 and the outlet header 33 of each heat exchanger 4 are provided with a pair of inlet pipes 45 and a pair of outlet pipes 46, respectively, and the inlet pipes 45 and the outlet pipes 46 are connected to the corresponding branch pipes 18 and 53 in a one to one relationship. However, it is also possible that the inlet header 31 and the outlet header 33 of each heat exchanger 4 are provided with only one inlet pipe 45 and only one outlet pipe 46, respectively. Also, it is all within the purview of the present invention if a plurality of branch pipes are commonly connected to a header of a same heat exchanger.

As shown in FIGS. 1 and 2, the downstream manifold 7 includes a downstream main pipe 51 extending linearly and in parallel with the upstream main pipe 16 of the upstream manifold 6 under the upstream main pipe 16, a single downstream outlet pipe 52 connected to an intermediate point of the downstream main pipe 51 with respect to the lengthwise direction thereof and a plurality of linear downstream branch pipes 53 connected to the downstream main pipe 51. The downstream branch pipes 53 are arranged at an interval along the length of the downstream main pipe 51. The downstream manifold 7 is connected to the outlet pipes 46 of the outlet headers 33 of the heat exchangers 4 at the terminal ends of the corresponding downstream branch pipes 53 by using threaded bolts or welding. Thereby, the refrigerant flows from the outlet header 33 of each heat exchanger 4 to the downstream main pipe 51 via the corresponding outlet pipes 46 and downstream branch pipe 53, and hence to the downstream outlet pipe 52. The downstream main pipe 51 is sufficiently greater in diameter than the downstream branch pipes 53. The downstream manifold 7 is positioned in such a manner that the connecting portion 54 between the downstream main pipe 51 and the downstream outlet pipe 52 is located on the reference line A. The connecting portion 54 is fixedly secured to the support member 21 on the reference line A by using a connecting member 55 such as a U bolt and a clamp. Thereby, the thermal expansion of the downstream manifold 7 occurs in such a manner that the downstream main pipe 51 elongates outwardly in the lengthwise direction thereof from the reference line A while the connecting portion 54 remains substantially fixed in position. The downstream manifold 7 may be supported by the support member 21 via deformable members (such as springs) at various points of the downstream main pipe 51 so as not to obstruct the thermal expansion of the downstream manifold 7.

The upstream manifold 6, the header units 37, the downstream manifold 7 and the connecting plates 41 are made of material or materials having a substantially same thermal expansion coefficient. For instance, the upstream manifold 6, the header units 37, the downstream manifold 7 and the connecting plates 41 may be made of a same material.

Each fan unit 5 comprises a fan main body 63 consisting of a cylindrical fan ring 61 and a fan 62 rotatably supported inside the fan ring 61, and a drive unit 64 for rotatively driving the fan 62. The drive unit 64 includes an electric motor 65 and a transmission unit 66 for connecting the rotary shaft of the electric motor 65 to the rotary shaft of the fan 62. In the fan unit 5, the fan main body 63 is supported by the fan support portion 14 provided under the corresponding heat exchanger 4. The fan unit 5 supplies air to the outer surfaces of the first and second tube bundles 35 and 36 from the downstream end thereof as the fan 62 rotates. In the illustrated embodiment, a single fan unit 5 is provided for each heat exchanger 4. However, a single fan unit 6 may be provided for a plurality of head exchangers 4.

In this air-cooled heat exchanger system 1 described above, the refrigerant is supplied to the upstream main pipe 16 via the upstream inlet pipe 17 of the upstream manifold 6, and distributed to the upstream branch pipes 18 before being fed to the individual heat exchangers 4. In each heat exchanger 4, the refrigerant flows in the inlet pipe 45, the inlet header 31, the first tube bundle 35, the intermediate header 32, the second tube bundle 36, the outlet header 33 and the outlet pipe 46, in that order. After passing through the heat exchangers 4, the refrigerant flows from the individual outlet pipes 46 into the downstream branch pipes 53 of the downstream manifold 7, and converges into the downstream main pipe 51 before flowing into the downstream outlet pipe 52. When flowing through the first and the second tube bundles 35 and 36 of each heat exchanger 4, the refrigerant exchanges heat with the air supplied by the corresponding fan unit 5 via the heat transfer tubes 34 forming the tube bundles, and is thereby cooled.

Figure 4:
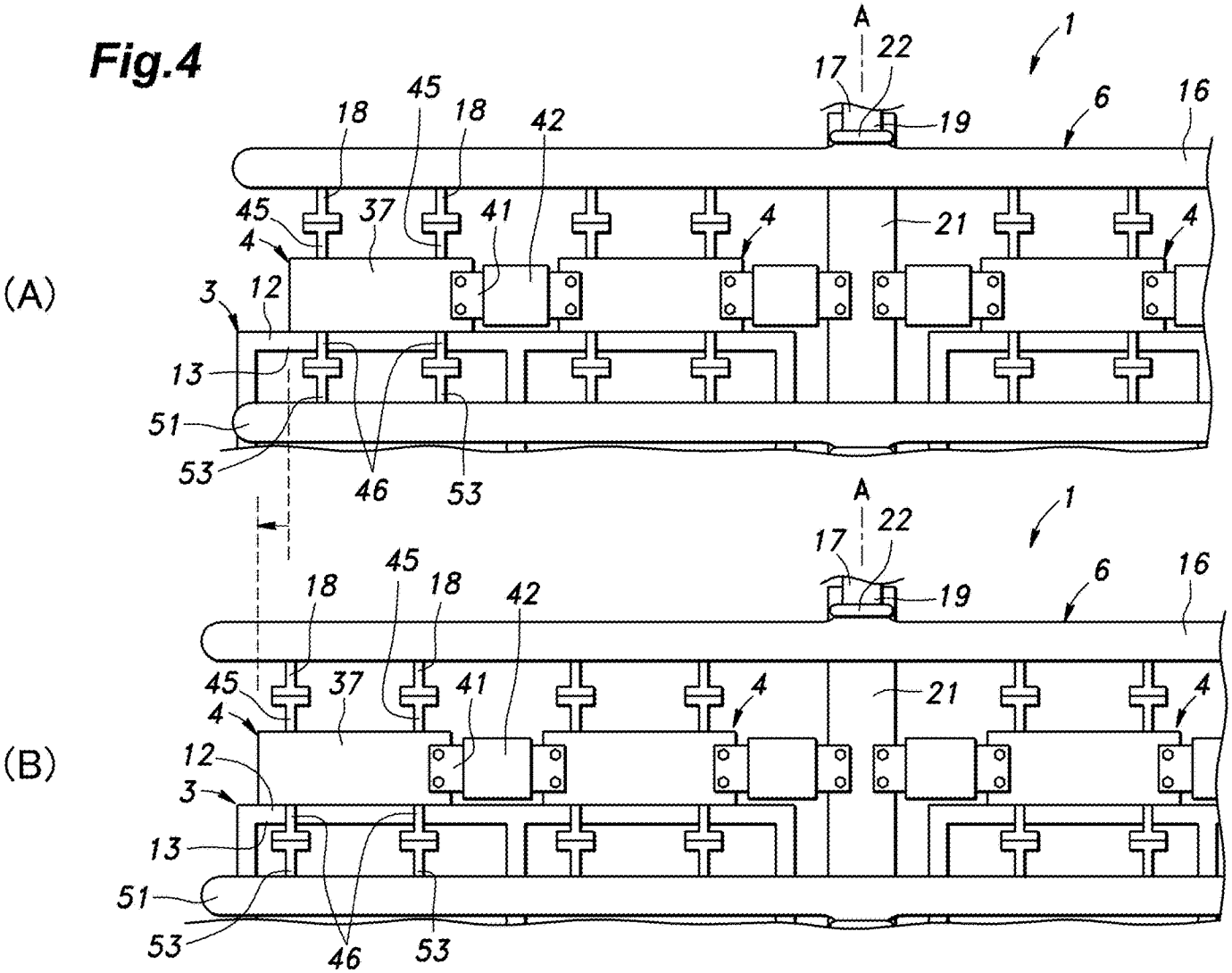
FIG. 4 is an illustrative view showing the air-cooled heat exchanger system of the first embodiment under normal condition (A) and under thermal expansion (B)

In the air-cooled heat exchanger system 1 of the preceding embodiment, because the header units 37 of the heat exchangers 4 are connected to one another via the corresponding connecting plate 41, as the upstream manifold 6 and the downstream manifold 7 expand thermally owing to the heat from the refrigerant flowing therein, the heat exchangers 4 are allowed to move relative to the base frame 3 so that the upstream branch pipes 18, the downstream branch pipes 53, the inlet pipes 45 and the outlet pipes 46 are prevented from being stressed. As shown in FIG. 4, when the upstream manifold 6 and the downstream manifold 7 are heated by the refrigerant flowing therein, and the upstream main pipe 16 and the downstream main pipe 51 are thereby caused to expand thermally with the reference line A defining a stationary central point, the header units 37 are heated by the refrigerant flowing in the header units 37, and the connecting plates 41 connected to the header units 37 are thereby heated. The header units 37 and the connecting plates 41 are connected to one another in series so as to form an array which is connected to the support member 21 at a middle point. Therefore, this array expands thermally in outward directions from the reference line A along the lengthwise direction of the upstream main pipe 16 and the downstream main pipe 51. As a result, the relative displacement between the upstream end and the downstream end of each upstream branch pipe 18, and hence the stress in the upstream branch pipe 18 is minimized. Likewise, the relative displacement between the upstream end and the downstream end of each downstream branch pipe 53, and hence the stress in the downstream branch pipe 53 is minimized. Therefore, the upstream branch pipes 18 and the downstream branch pipes 53 are not required to be provided with structures for creating flexibility such as elbows, and this simplifies the piping arrangement of the upstream branch pipes 18 and the downstream branch pipes 53. This contributes to the reduction of the manufacturing cost.

Second Embodiment

Figure 5:
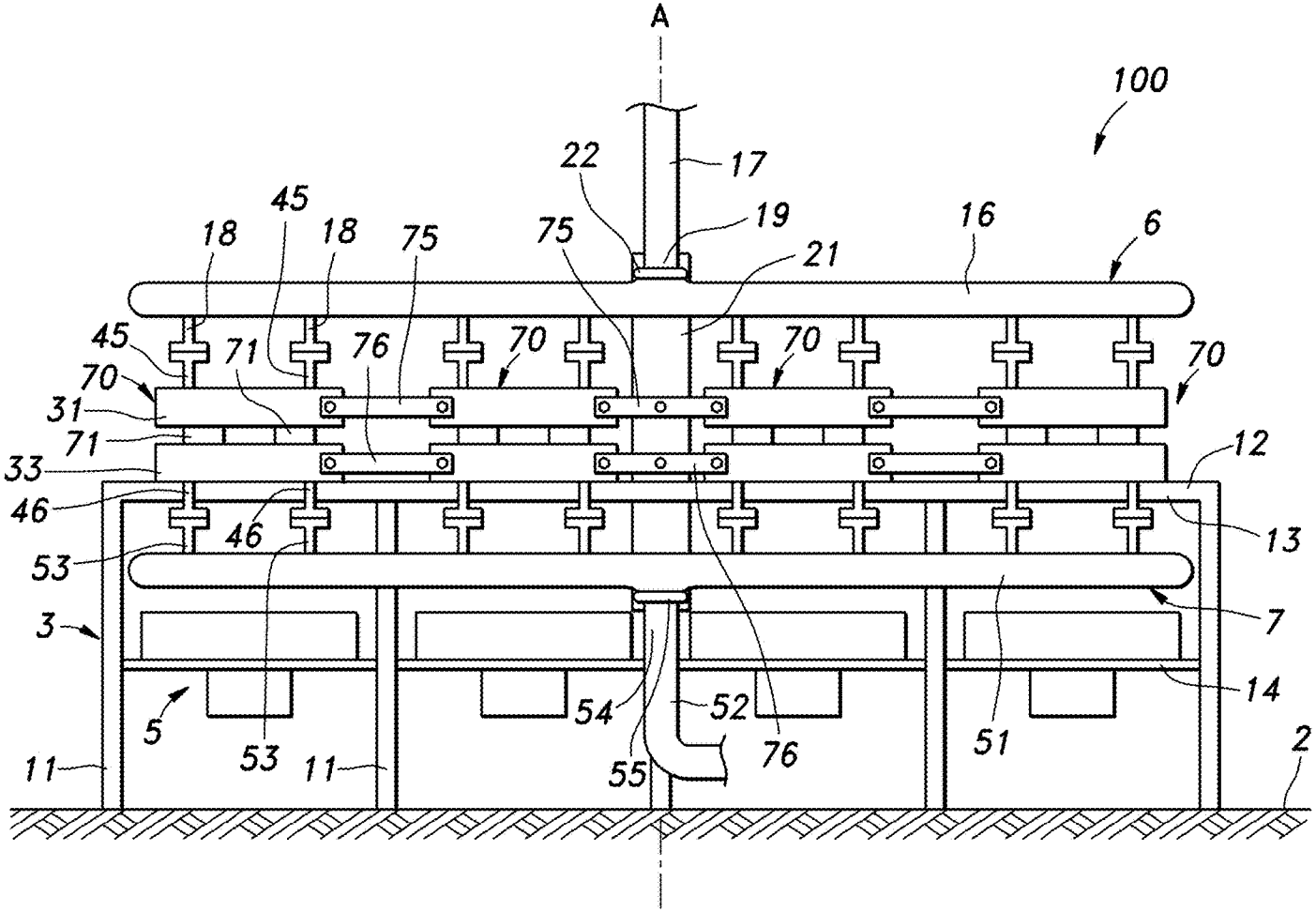
FIG. 5 is a side view showing an air-cooled heat exchanger system given as a second embodiment of the present invention.
Figure 6:
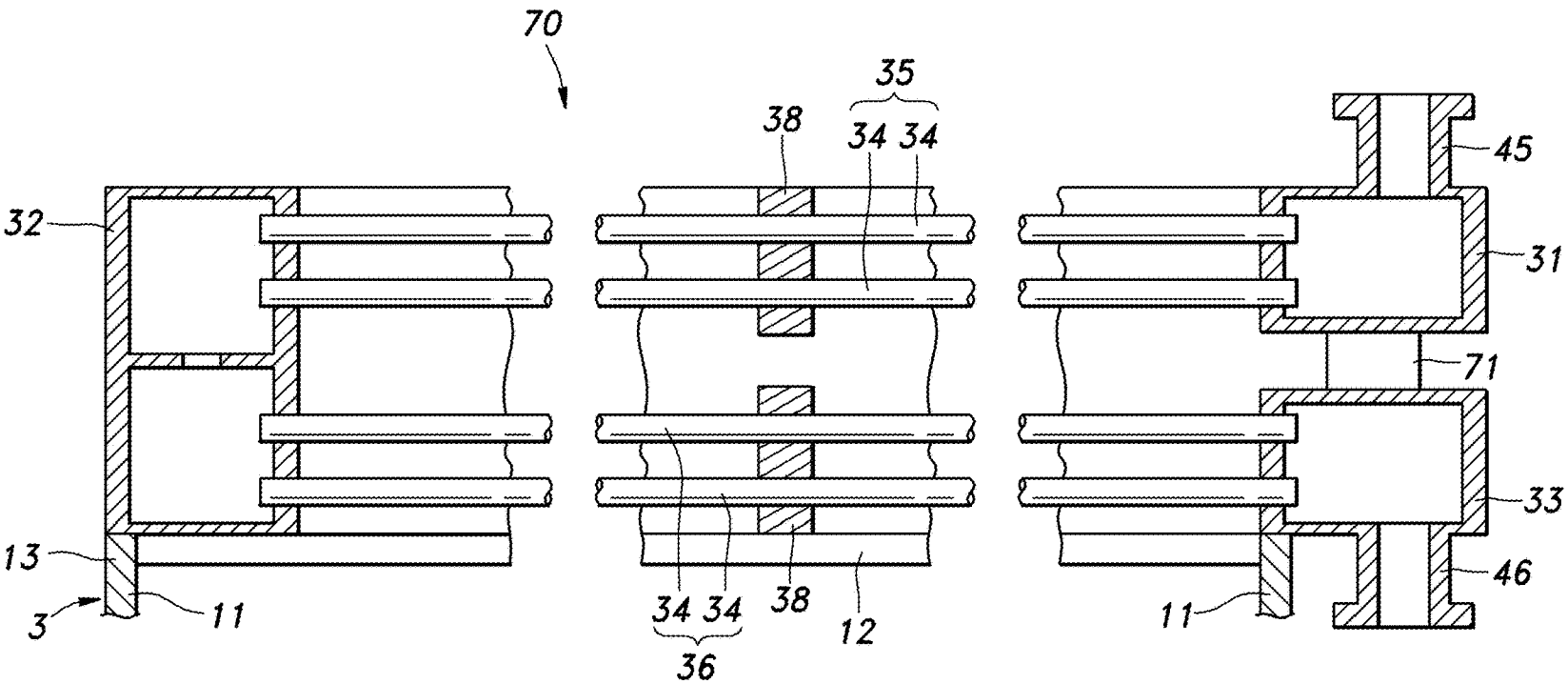
FIG. 6 is a sectional view of one of the heat exchangers.
Figure 7:
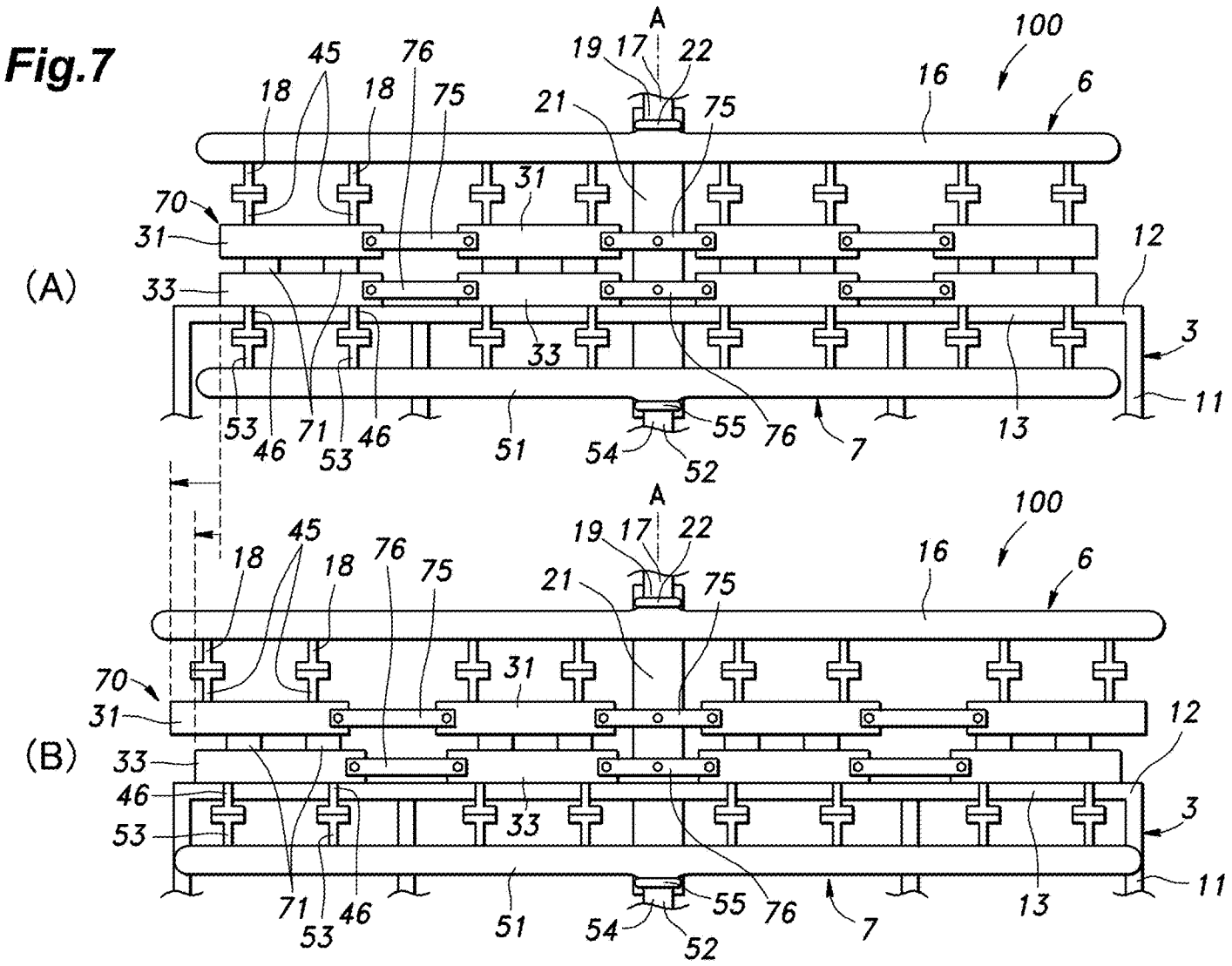
FIG. 7 is an illustrative view showing the air-cooled heat exchanger system of the second embodiment under normal condition (A) and under thermal expansion (B)
Figure 8:
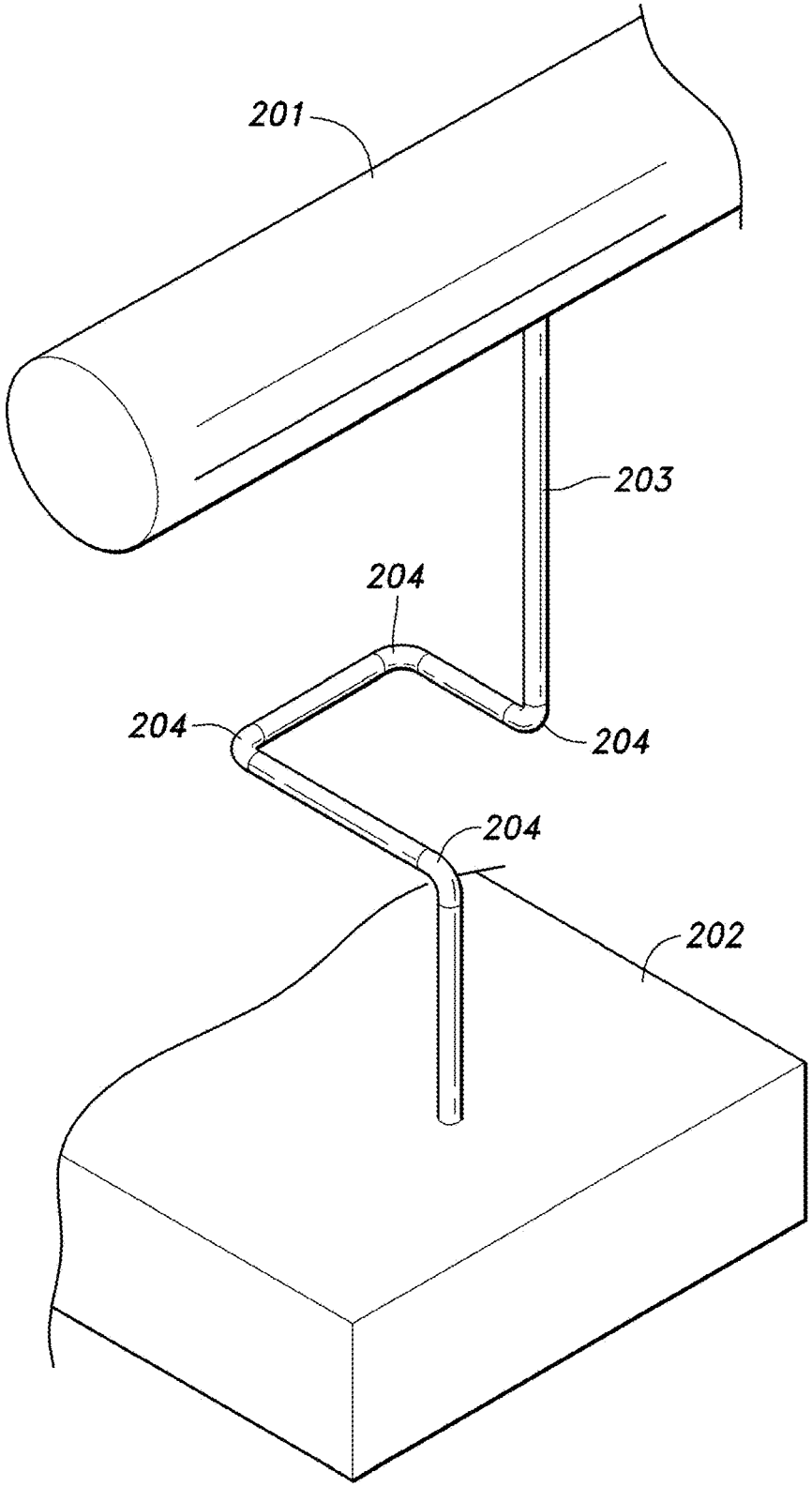
FIG. 8 is a view showing a connecting pipe connecting an upstream manifold with a heat exchanger according to a conventional arrangement.

An air-cooled heat exchanger system 100 given as a second embodiment of the present invention is described in the following with reference to FIGS. 5 to 7. The air-cooled heat exchanger system 100 of the second embodiment is similar to the air-cooled heat exchanger system 1 of the first embodiment except for the structures of the heat exchangers 4 and the connecting plates 41. In the description of the second embodiment, the parts corresponding to those of the first embodiment are denoted with like numerals without repeating the description of such parts.

In each of the heat exchangers 70 in the air-cooled heat exchanger system 100, the inlet header 31 is separated from the outlet header 33. The outlet header 33 is provided with a smooth flat upper surface, and a planar insert member 71 is placed on this upper surface. The insert member 71 may be made of low-friction material such as fluoride resin. Alternatively, the insert member 71 may also be made of deformable member. On the upper surface of the insert member 71 rests the inlet header 31. The tube spacer 38 is separated into two parts, one part supporting the first tube bundle 35, and the other part supporting the second tube bundle 36. Owing to this structure, the inlet header 31 is moveable in the lengthwise direction of the upstream main pipe 16 with respect to the outlet header 33. When the inlet header 31 is displaced relative to the outlet header 33, the inlet header 31 may slide over the insert member 71 or the insert member 71 may slide over the outlet header 33. Alternatively, the insert member 71 may be deformed. As a modified embodiment, the inlet header 31 may be placed directly on the upper surface of the outlet header 33 so that the inlet header 31 may slide over the outlet header 33. As the inlet header 31 slides over the outlet header 33, at least one of the first tube bundle 35 and the second tube bundle 36 inevitably undergoes an elastic deformation. As the length of the first tube bundle 35 and the second tube bundle 36 is sufficiently long in relation to the relative displacement between the inlet header 31 and the outlet header 33, the displacement of the inlet header 31 with respect to the outlet header 33 does not cause any damage to the first tube bundle 35 and the second tube bundle 36.

The inlet header 31 of each heat exchanger 70 is connected to the inlet header 31 of the adjacent heat exchanger 70 along the length of the upstream main pipe 16 via an inlet side connecting plate 75. The inlet header 31 of the heat exchanger 70 adjoining the reference line A is connected to the support member 21 via an inlet side connecting plate 75. Likewise, the outlet header 33 of each heat exchanger 70 is connected to the outlet header 33 of the adjacent heat exchanger 70 along the length of the upstream main pipe 16 via an outlet side connecting plate 76. The outlet header 33 of the heat exchanger 70 adjoining the reference line A is connected to the support member 21 via an outlet side connecting plate 76. In this embodiment, the support member 21 is connected to the base frame 3. Each of the inlet side and outlet side connecting plates 75 and 76 is planar in shape, and has a major plane extending perpendicularly to the lengthwise direction of the first and second tube bundles 35 and 36. Each of the inlet side and outlet side connecting plates 75 and 76 may be in most part covered by insulating material.

In this embodiment, the upstream manifold 6, the inlet header 31, the outlet header 33, the downstream manifold 7, the inlet side connecting plates 75 and the outlet side connecting plates 76 are made of material or materials having a substantially same thermal expansion coefficient. For instance, the upstream manifold 6, the header units 37, the downstream manifold 7 and the connecting plates 41 may be made of a same material so that they all have a same thermal expansion coefficient.

In the air-cooled heat exchanger system 100 of the second embodiment, the inlet header 31 is movable relative to the outlet header 33, and the outlet header 33 is moveable relative to the base frame 3. The refrigerant is cooled as it flows through the first and second tube bundles 35 and 36, the temperature in the upstream manifold 6 and the inlet header 31 preceding the tube bundles is substantially uniform, and so is the temperature in the outlet header 33 and the downstream manifold 7 following the tube bundles. Therefore, as shown in part (B) of FIG. 7, the array of the inlet headers 31 and the inlet side connecting plates 75 displaces with respect to the base frame 3 more than the array of the outlet headers 33 and the outlet side connecting plates 76 so that the arrays can better adapt to the upstream main pipe 16 which expands more than the downstream main pipe 51 owing to the higher temperature thereof. Therefore, the air-cooled heat exchanger system 100 of the second embodiment can even more effectively reduce the stress in the upstream branch pipes 18 and the downstream branch pipes 53 than the air-cooled heat exchanger system 1 of the first embodiment.

The present invention was described in terms of specific embodiments, but the present invention is not limited by the illustrated embodiments, and can be changed in various parts thereof. For instance, the various components are connected to the support members so that the thermal expansion occurs around the reference line A in the foregoing embodiments, but the support members can be omitted in a certain embodiment of the present invention. The shape of the base frame 3 and the location of the fan units 5 can be changed freely without departing from the spirit of the present invention. Furthermore, that the connecting member has a substantially same thermal expansion coefficient as the upstream main pipe does not necessarily means that the two members have an approximately same thermal coefficient, but that the array consisting of the inlet headers and the connecting plates demonstrate a similar thermal expansion property as the upstream main pipe of the upstream manifold.

The contents of the original Japanese patent application on which the Paris Convention priority claim is made for the present application as well as the contents of the prior art references mentioned in this application are incorporated in this application by reference.

Glossary

1, 100 air-cooled heat exchanger system
2 base surface
3 base frame
4, 70 heat exchanger
5 fan unit
6 upstream manifold
7 downstream manifold
16 upstream main pipe
17 upstream inlet pipe
18 upstream branch pipe
21 support member
31 inlet header
32 intermediate header
33 outlet header
34 heat transfer tube
35 first tube bundle
36 second tube bundle
37 header unit
41 connecting plate (connecting member)
42 thermal insulation material
45 inlet pipe
46 outlet pipe
51 downstream main pipe
52 downstream outlet pipe
53 downstream branch pipe
71 insert member
75 inlet connecting plate (connecting member)
76 outlet connecting plate (connecting member)
A reference line

The invention claimed is:

1. An air-cooled heat exchanger system, comprising:

a base frame;

an upstream manifold including an upstream main pipe extending in a first direction, an upstream inlet pipe communicating with the upstream main pipe to feed fluid to the upstream main pipe, and a plurality of branch pipes extending from the upstream main pipe at different points along the first direction;

a plurality of heat exchangers arranged along the first direction, each heat exchanger including an inlet header communicating with a corresponding one of the branch pipes, wherein the inlet header is mounted on the base frame so as to be moveable in the first direction relative to the base frame while in operation, a tube bundle extending in a second direction substantially perpendicular to the first direction and communicating with the inlet header at one end thereof, and an outlet header communicating with the other end of the tube bundle; and a connecting member elongated in the first direction to have a larger dimension in the first direction than in the second direction and connecting the inlet headers of adjoining two of the plurality of heat exchangers to each other while allowing the inlet headers to move in the first direction relative to the base frame while in operation, the connecting member having the same thermal expansion coefficient as the upstream main pipe;

wherein the connecting member is at least partly covered by a thermal insulation material.

2. The air-cooled heat exchanger system according to claim 1, wherein the inlet header of each heat exchanger is moveably mounted on the base frame via a member made of fluoride resin.

3. The air-cooled heat exchanger system according to claim 1, wherein the inlet header of each heat exchanger is moveably mounted on the base frame via a deformable member.

4. The air-cooled heat exchanger system according to claim 1, wherein one of the inlet header and the outlet header of each heat exchanger is placed above the other, and the tube bundle of each heat exchanger includes a first tube bundle extending from the inlet header in the second direction and a second tube bundle extending from a remote end of the first tube bundle to the outlet header in parallel with the first tube bundle, and wherein the system further includes a downstream manifold including a downstream main pipe extending in the first direction, a downstream outlet pipe communicating with the downstream main pipe to expel fluid from the downstream main pipe, and a plurality of branch pipes extending from the downstream main pipe at different points along the first direction, and each communicating with the outlet header of a corresponding one of the heat exchangers.

5. The air-cooled heat exchanger system according to claim 4, wherein each heat exchanger further includes an intermediate header which is connected between the remote end of the first tube bundle and a corresponding end of the second tube bundle.

6. The air-cooled heat exchanger system according to claim 4, wherein the inlet header and the outlet header of each heat exchanger are fixedly attached to each other so as to jointly form a header unit, and the header unit is moveably supported by the base frame.

7. The air-cooled heat exchanger system according to claim 4, wherein the inlet header and the outlet header of each heat exchanger are separated from each other and both supported by the base frame such that the inlet header is moveable in the first direction with respect to the outlet header.

8. The air-cooled heat exchanger system according to claim 7, wherein the outlet headers of the adjoining two of the heat exchangers are connected to each other via another connecting member elongated in the first direction to have a larger dimension in the first direction than in the second direction separately from the inlet headers.

9. The air-cooled heat exchanger system according to claim 1, wherein the upstream inlet pipe is connected to an intermediate point of the upstream main pipe, the intermediate point being fixedly attached to a fixed support member.

10. The air-cooled heat exchanger system according to claim 9, wherein the inlet header of the heat exchanger adjacent to the support member is connected to the support member via the connecting member.

* * * * *